US011721154B2

(12) United States Patent
Blythin et al.

(10) Patent No.: US 11,721,154 B2
(45) Date of Patent: Aug. 8, 2023

(54) COIN PAYOUT APPARATUS

(71) Applicant: Crane Payment Innovations, Inc., Malvern, PA (US)

(72) Inventors: Robert James Blythin, Shropshire (GB); Graham Richard Jones, Lancashire (GB)

(73) Assignee: Crane Payment Innovations, Inc., Malvern, PA (US)

( * ) Notice: Subject to any disclaimer, the term of this patent is extended or adjusted under 35 U.S.C. 154(b) by 159 days.

(21) Appl. No.: 16/621,847

(22) PCT Filed: Oct. 10, 2018

(86) PCT No.: PCT/US2018/055282

§ 371 (c)(1),
(2) Date: Dec. 12, 2019

(87) PCT Pub. No.: WO2019/075111

PCT Pub. Date: Apr. 18, 2019

(65) Prior Publication Data

US 2021/0090370 A1 Mar. 25, 2021

Related U.S. Application Data

(60) Provisional application No. 62/570,253, filed on Oct. 10, 2017.

(51) Int. Cl.

| | |
|---|---|
| ***G07D 9/06*** | (2006.01) |
| ***G07D 1/02*** | (2006.01) |
| ***G07F 5/24*** | (2006.01) |

(52) U.S. Cl.

CPC ..... *G07D 9/06* (2013.01); *G07D 1/02* (2013.01); *G07F 5/24* (2013.01); *G07D 2201/00* (2013.01)

(58) Field of Classification Search

CPC ..... G07D 1/02; G07D 2201/00; G07D 1/00; G07D 9/06; G07F 5/24; G07F 11/50;
(Continued)

(56) References Cited

U.S. PATENT DOCUMENTS 2,587,809 A * 3/1952 Arnett ..... G07D 1/00 453/29
2,705,964 A * 4/1955 Bernstein ..... G07D 1/00 453/38

(Continued)

FOREIGN PATENT DOCUMENTS

GB 2335775 A 9/1999
JP H07-272035 A 10/1995

(Continued)

OTHER PUBLICATIONS

KR 20100009209 A English Translation (merged with original document) (Year: 2010).*

(Continued)

*Primary Examiner* — Jeffrey A Shapiro

(57) ABSTRACT

A coin payout apparatus 100 is provided. The coin payout apparatus 100 includes a coin canister 101. The coin canister 101 includes a tube 102 for storing coins. The coin canister 101 also includes a coin ejector 202 operable to eject a coin from the tube 102. The coin canister 101 further includes a hopping disc 318 operable to rotate and engage the coin ejector 202 to eject the coin from the tube 102 when the tube 102 is moved into position with the hopping disc 318.

21 Claims, 10 Drawing Sheets

(58) Field of Classification Search
CPC ..... G07F 11/02; G07F 11/20; G07F 11/22; G07F 11/24
USPC ..... 453/44–48; 221/119–121, 123, 124, 132, 221/133, 151–153, 268, 272–275
See application file for complete search history.

(56) References Cited

U.S. PATENT DOCUMENTS

| | | | | |
|---|---|---|---|---|
| 3,034,517 | A | 5/1962 | Reiland | |
| 3,191,609 | A * | 6/1965 | Gauselmann et al. | G07D 1/00 453/40 |
| 4,276,894 | A | 7/1981 | Heywood | |
| 5,492,212 | A * | 2/1996 | Fillod | G07F 1/047 453/3 |
| 5,605,249 | A | 2/1997 | Gonyea | |
| 6,540,602 | B2 * | 4/2003 | Adams | G07D 1/00 453/40 |
| 6,837,783 | B2 * | 1/2005 | Hunt-Vincent | G07D 1/00 453/44 |
| 8,262,441 | B2 * | 9/2012 | Chang | G07D 1/00 453/18 |
| 2001/0055946 | A1 * | 12/2001 | Cost | G07D 1/00 453/40 |
| 2002/0115403 | A1 | 8/2002 | Adams et al. | |
| 2004/0040820 | A1 * | 3/2004 | Adams | G07F 9/08 194/216 |
| 2019/0347887 | A1 * | 11/2019 | Roodenburg | G07D 1/00 |

FOREIGN PATENT DOCUMENTS

| | | | | |
|---|---|---|---|---|
| JP | 3325110 | B2 | 9/2002 | |
| KR | 20100009209 | A * | 1/2010 | G07F 5/02 |
| WO | 9950795 | A1 | 10/1999 | |

OTHER PUBLICATIONS

International Search Report in connection with International Application No. PCT/US2018/055282 dated Dec. 26, 2018, 3 pages.
Written Opinion in connection with International Application No. PCT/US2018/055282 dated Dec. 26, 2018, 6 pages.
International Preliminary Report on Patentability in connection with International Application No. PCT/US2018/055282 dated Apr. 23, 2020, 8 pages.
Communication pursuant to Article 94(3) EPC dated Jun. 25, 2021, in connection with European Patent Application No. 18865481.8, 6 pages.
Communication pursuant to Article 94(3) EPC dated Apr. 14, 2023, in connection with European Application No. 18865481.8, 6 pages.

* cited by examiner

COIN PAYOUT APPARATUS

CROSS-REFERENCE TO RELATED APPLICATIONS

This application is a 371 of International Application No. PCT/US2018/055282 filed on Oct. 10, 2018, which claims priority to U.S. Provisional Application No. 62/570,253 filed on Oct. 10, 2017, the disclosures of which are herein incorporated by reference in their entirety.

TECHNICAL FIELD

This disclosure is generally directed to money item canisters. More specifically, this disclosure is directed to a coin turret payout apparatus.

BACKGROUND

Current money item canisters are used by merchants to store and dispense currency. These money item canisters are often placed on counters at or near a cash register to store and dispense currency for a currency transaction. Due to their footprint size, these current money item canisters limit free counter space at or near the cash register to conduct a transaction or sell additional products. Merchants are left to sacrifice valuable counter space at or near a cash register to accommodate these current money item canisters.

SUMMARY

This disclosure provides a coin payout apparatus.

In a first embodiment, a coin payout apparatus is provided. The coin payout apparatus includes a coin canister. The coin canister includes a tube for storing coins. The coin canister also includes a coin ejector operable to eject a coin from the tube. The coin canister further includes a hopping disc operable to rotate and engage the coin ejector to eject the coin from the tube when the tube is moved into position with the hopping disc.

In a second embodiment, a coin payout apparatus is provided. The coin payout apparatus includes a coin canister. The coin canister includes a tube for storing coins. The coin canister also includes a coin ejector operable to eject a coin from the tube. The coin canister further includes a hopping disc operable to rotate and engage the coin ejector to eject the coin from the tube when the tube is moved into position with the hopping disc. The coin payout apparatus also includes a motor assembly. The motor assembly includes a payout motor operable to rotate the hopping disc to engage the coin ejector when the tube is moved into position with the hopping disc.

In a third embodiment, a coin payout apparatus is provided. The coin payout apparatus includes a coin canister. The coin canister includes a first tube for storing coins. The coin canister also includes a second tube for storing coins. The coin canister further includes a first coin ejector operable to eject a coin from the first tube. In addition, the coin canister includes a second coin ejector operable to eject a coin from the second tube. The coin canister also includes a hopping disc. The hopping disc is operable to rotate and engage the first coin ejector to eject the coin from the first tube when the first tube is moved into position with the hopping disc. The hopping disc is also operable to rotate and engage the second coin ejector to eject the coin from the second tube when the second tube is moved into position with the hopping disc.

Other technical features may be readily apparent to one skilled in the art from the following figures, descriptions, and claims.

Definitions for other certain words and phrases are provided throughout this patent document. Those of ordinary skill in the art should understand that in many if not most instances, such definitions apply to prior as well as future uses of such defined words and phrases.

BRIEF DESCRIPTION OF THE DRAWINGS

For a more complete understanding of this disclosure and its advantages, reference is now made to the following description, taken in conjunction with the accompanying drawings, in which.

Figure 1:
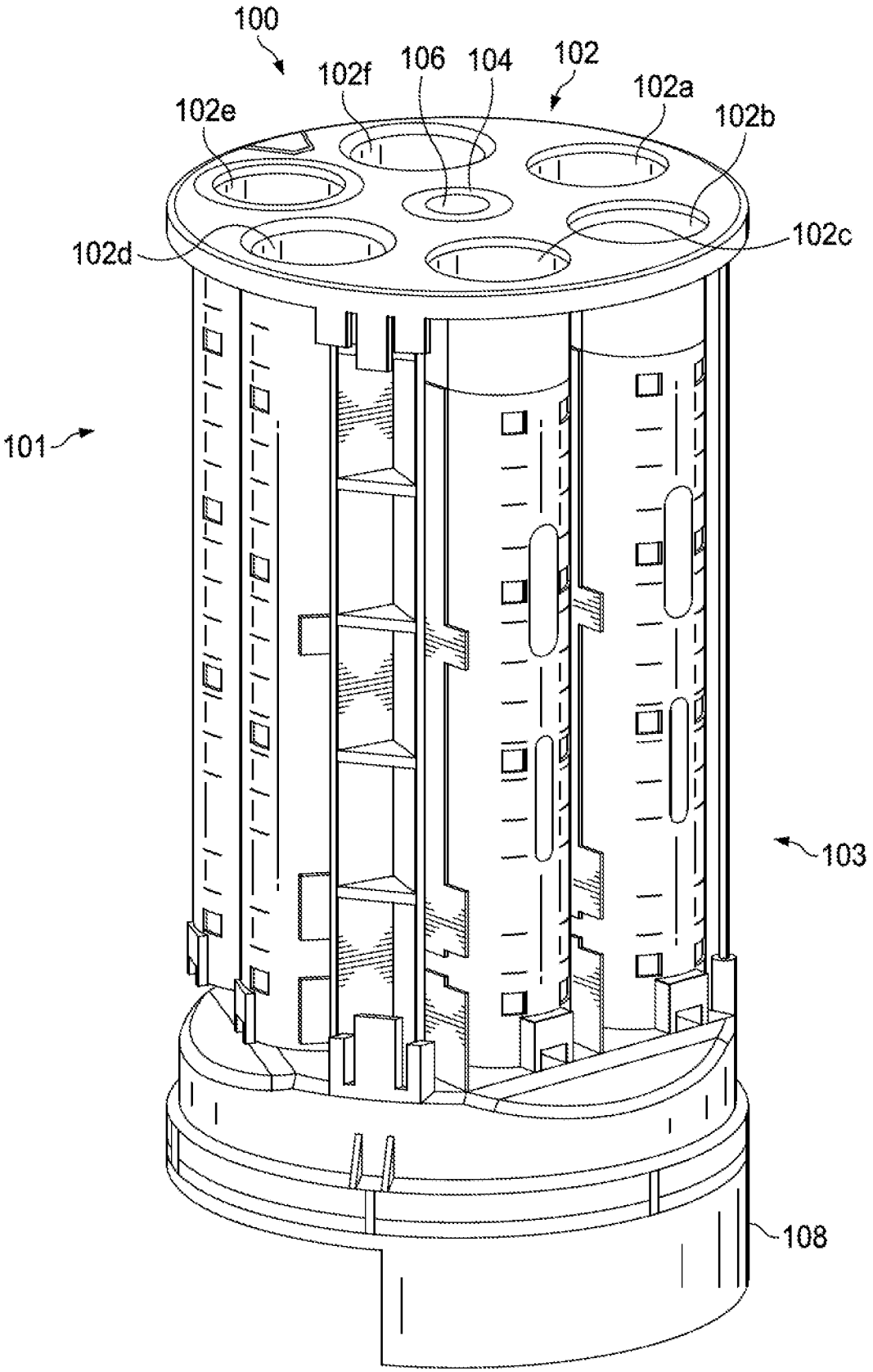
FIG. 1 illustrates a coin canister of a coin payout apparatus in accordance with various embodiments of the present disclosure.

Before undertaking the DETAILED DESCRIPTION below, it may be advantageous to set forth definitions of certain words and phrases used throughout this patent document. The term "couple" and its derivatives refer to any direct or indirect communication or interaction between two or more elements, whether or not those elements are in physical contact with one another. The terms "transmit," "receive," and "communicate," as well as derivatives thereof, encompass both direct and indirect communication. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The term "controller" means any device, system or part thereof that controls at least one operation. Such a controller may be implemented in hardware or a combination of hardware and software and/or firmware. The functionality associated with any particular controller may be centralized or distributed, whether locally or remotely. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disc drive, a compact disc (CD), a digital video disc (DVD), or any other type of non-volatile/memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for other certain words and phrases are provided throughout this patent document. Those of ordinary skill in the art should understand that in many if not most instances, such definitions apply to prior as well as future uses of such defined words and phrases.

DETAILED DESCRIPTION

FIGS. 1 through 6C, discussed herein, and the various embodiments used to describe the principles of this disclosure in this patent document are by way of illustration only and should not be construed in any way to limit the scope of the disclosure. Those skilled in the art will understand that the principles of this disclosure may be implemented in any suitably arranged coin payout apparatus.

The purpose of this disclosure is the ability to pay money items from multiple, single denomination tubes that act as individual hoppers in a small space envelope. The main drive behind this invention is the intention of making a mixed denomination money item recycler in the smallest possible space envelope so that it could be placed on table tops in small retailers, fast food environments, or other applications where space is at a premium.

Referring now to FIG. 1, there is illustrated a coin payout apparatus 100 including a coin canister 101 in accordance with various embodiments of the present disclosure. The coin canister 101 may have a cylindrical body 103 and may include one or more of tubes 102 each having a position around the perimeter of the coin canister 101 and each extending the height of the cylindrical body 103. In certain embodiments, as shown in FIG. 1, the coin canister 101 includes six tubes such as a first tube 102*a*, a second tube 102*b*, a third tube 102*c*, a fourth tube 102*d*, a fifth tube 102*e*, and a sixth tube 102*f*. Each of the tubes 102 is configured to hold or retain one or more coins in a stacked orientation. Each of the tubes 102 may have a diameter according to a type or denomination of a coin to be held or retained within the tube 102. Thus, when the coin canister 101 includes a plurality of tubes 102, the coin canister 101 may hold or retain multiple different denominations of coins for dispensing. The coin canister 101 may also include a hollowed out or bored center 104 to allow the coin canister 101 to be placed onto a rotatable shaft 106 so that the coin canister 101 may be rotated over and with respect to a base or a bottom 108. A motor assembly (e.g., motor assembly 600 described herein) or another apparatus to facilitate coin dispensing operations may be installed below and to the bottom 108 of the coin canister 101 and may be of a small form factor to allow for the coin payout apparatus 100 to operate in a small space. The coin canister 101 may have a coin canister base 107 to support coins retained in each of coin tubes 102.

For example, referring to FIG. 1, the cylindrical body 103 of the coin canister 101 may rotate with the rotatable shaft 106 about the bored center 104 in a clockwise or a counterclockwise direction. As the cylindrical body 103 rotates, a position of each tube 102 of the plurality of tubes 102 changes with respect to the static bottom 108 of the coin canister 101. Thus, as will be described herein, a tube 102 may be moved into position with respect to a component with the static bottom 108 of the coin canister 101. In certain embodiments, a rotation of the cylindrical body 103 of the coin canister 101 may move a tube 102 into position with a hopping disc (e.g., a hopping disc 318 described herein). In certain embodiments, a rotation of the cylindrical body 103 of the coin canister 101 may move a tube 102 out of position with a hopping disc (e.g., a hopping disc 318 described herein).

Figure 2A:
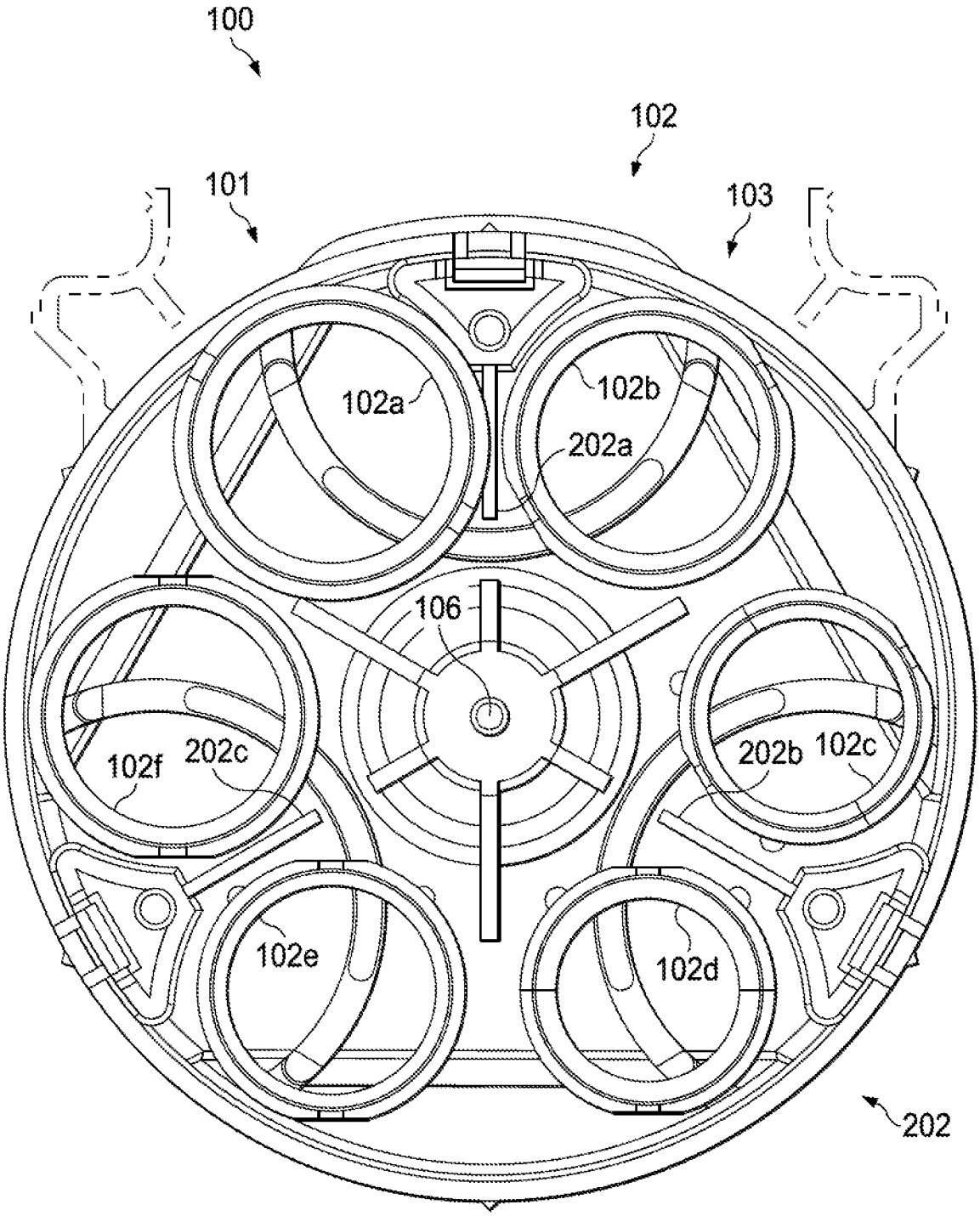
FIG. 2A illustrates a top view of the coin canister disposed on a motor assembly in accordance with various embodiments of the present disclosure.

Referring now to FIG. 2A, there is illustrated a top view of the coin canister 101 disposed on a motor assembly (e.g., motor assembly 600 described herein). The coin canister 101 may be centered on the rotatable shaft 106 that, when the motor assembly is operating, turns the cylindrical body 103 of the coin canister 101 to change a position of the one or more of tubes 102 of the coin canister 101 over the motor assembly and with respect to the static bottom 108. For example, the cylindrical body 103 of the coin canister 101 may move or rotate between two positions (e.g., a first position and a second position), three positions (e.g., a first position, a second position, and a third position), four positions (e.g., a first position, a second position, a third position, and a fourth position), or the like.

The coin canister 101 may also include one or more ejectors or coin ejectors 202 (hereinafter "coin ejectors") disposed underneath the one or more tubes 102. The coin ejectors 202 may be used as described herein to eject coins from the coin canister 101 by rotating and pushing a bottom coin in a tube 102 out of the tube 102 and out of the coin canister 101. In certain embodiments, a single tube 102 may be paired with a coin ejector 202 such that the single tube 102 rotates with and is disposed over the coin ejector 202. For example, a coin ejector 202 may be able to eject a coin from only a single tube 102 associated with the coin ejector 202 by rotating and pushing a bottom coin out of the tube 102 when the single tube is positioned above a payout position (e.g., positioned with a hopping disc 318 described herein). In certain embodiments, the coin ejectors 202 may have paths 207 to rotate in the coin canister base 107. The paths 207 may be created by cavities in coin canister base 107. For example, the coin canister base 107 may have at least two sections, such as a first section 107*a* and a second section 107*b*. The first section 107*a* may be a horizontal section that supports coins retained in each of the coin tubes 102. The second section 107*b* may be an angled section that provides a path for ejected coins to move from the coin tubes 102 to the payout location.

In certain embodiments, the tubes 102 may be paired such that two tubes 102 are disposed over and rotate with an associated coin ejector 202 that is able to eject from either one of the two associated tubes 102 depending on which of the two associated tubes 102 is above a payout position. For example, as illustrated in FIG. 2A, the first tube 102*a* and the second tube 102*b* are paired over a first ejector 202*a*, the third tube 102*c* and the fourth tube 102*d* are paired over a second ejector 202*b*, and the fifth tube 102*e* and the sixth tube 102*f* are paired over a third ejector 202*c*. The cylindrical body 103 of the coin canister 101 may rotate between three positions in order to position the tubes 102 for coin ejection. The fourth tube 102*d* and the fifth tube 102*e*, when positioned as shown in FIG. 2A, may be oriented over a chute for receiving coins paid out from the fourth tube 102*d* and the fifth tube 102*e*. As the coin canister 101 rotates between the three positions, other tubes 102 may be positioned over the chute.

Figure 2B:
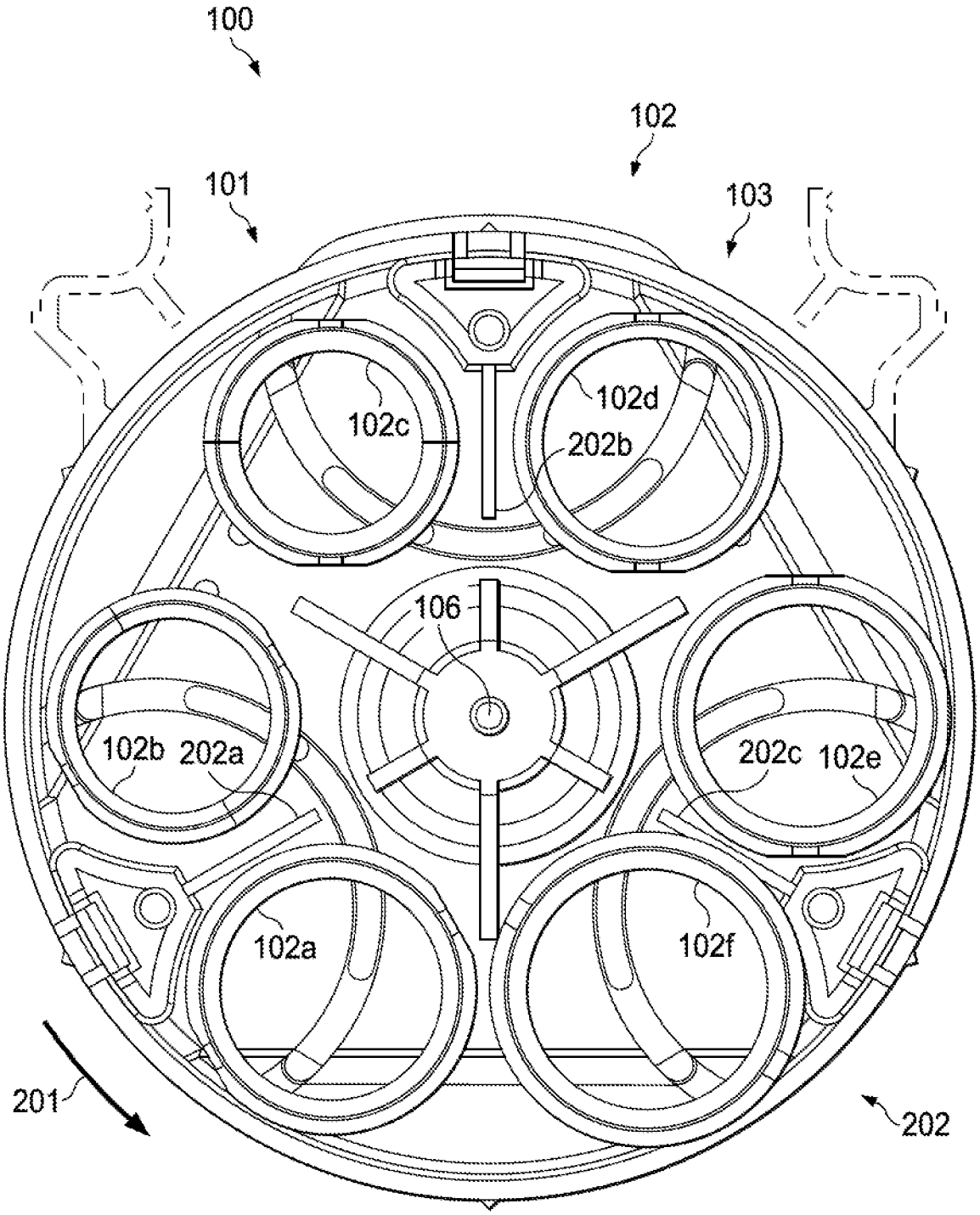
FIG. 2B illustrates a top view of the coin canister after being rotated counter-clockwise one position in accordance with various embodiments of the present disclosure.

Referring now to FIG. 2B, there is illustrated a top view of the coin canister 101 after the cylindrical body 103 of the coin canister 101 is rotated counter-clockwise one position. A single counter-clockwise position change (indicated by arrow 201) from the position shown in FIG. 2A results in the first tube 102*a* and the sixth tube 102*f* being oriented over the chute for receiving coins paid out from the first tube 102*a* and the sixth tube 102*f*. The coin ejectors 202 may also move with their associated tubes 102 such that a coin ejector 202 is always disposed beneath the same one or more tubes 102. For example, as shown in FIG. 2B, during the counter-clockwise rotation, the first coin ejector 202*a* remains associated with the first tube 102*a* and the second tube 102*b*, the second coin ejector 202*b* remains associated with the third tube 102*c* and the fourth tube 102*d*, and the third coin ejector 202*c* remains associated with the fifth tube 102*e* and the sixth tube 102*f*.

The coin canister 101 may include two payout positions. For example, in FIG. 2A, the payout positions would be at the fourth tube 102*d* and the fifth tube 102*e*, with the second coin ejector 202*b* being disposed below the third tube 102*c* and the fourth tube 102*d* causing coins to be ejected from the fourth tube 102*d*, and the third ejector 202*c* being disposed below the fifth tube 102*e* and the sixth tube 102*f* causing coins to be ejected from the fifth tube 102*e*. In FIG. 2B, the payout positions would be at the first tube 102*a* and the sixth tube 102*f*, with the first coin ejector 202*a* being disposed below the first tube 102*a* and the second tube 102*b* causing coins to be ejected from the first tube 102*a*, and the third coin ejector 202*c* being disposed below the fifth tube 102*e* and the sixth tube 102*f* causing coins to be ejected from the sixth tube 102*f*.

It should be understood that, in the aforementioned embodiments, each tube 102 of the plurality of tubes 102 may have only one payout position. For example, the first tube 102*a*, the third tube 102*c*, and the fifth tube 102*e* may be moved into a first payout position (e.g., moved into position with a first hopping disc) while the second tube 102*b*, the fourth tube 102*d*, and the sixth tube 102*f* may be moved into a second payout position (e.g., moved into position with a second hopping disc). In some embodiments, one or more additional payout positions may be provided for one or more tubes 102 of the plurality of tube 102. For example, the first tube 102*a*, the third tube 102*c*, and the fifth tube 102*e* may have two payout positions (e.g., two hopping discs). In certain embodiments, all the tubes 102 may share a same payout position. For example, each tube 102 of the plurality of tubes 102 may have an unshared coin ejector 202. In this case, each tube 102 may move into position at the same payout position to dispense a coin.

Figure 3:
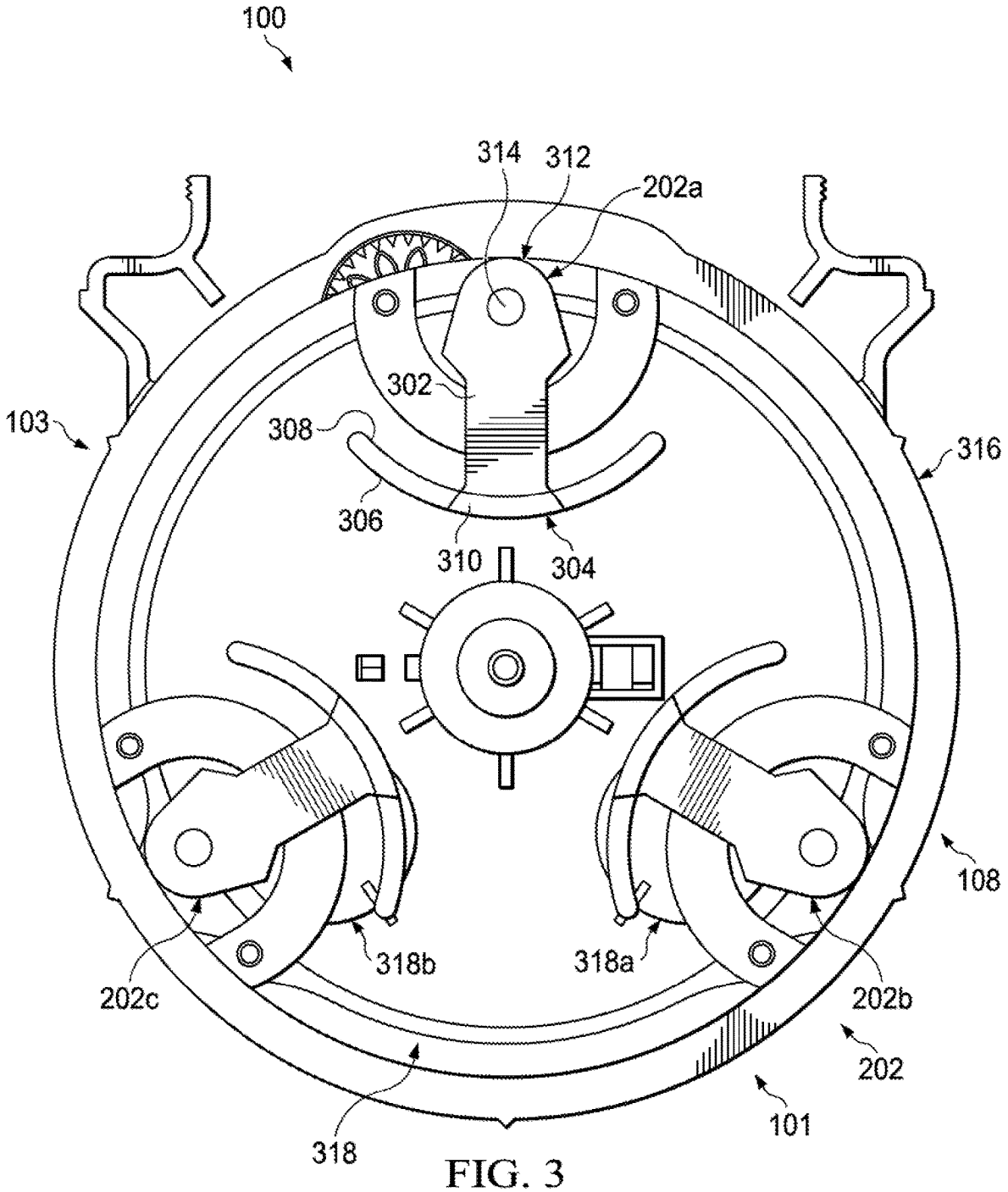
FIG. 3 illustrates a top view of the coin canister with the tubes removed in accordance with various embodiments of the present disclosure.

Referring now to FIG. 3, there is illustrated a top view of the coin canister 101 without the tubes 102. Removing the tubes 102 reveals the configuration of each of the coin ejectors 202. The first coin ejector 202*a*, the second coin ejector 202*b*, and the third coin ejector 202*c* are shown with the first coin ejector 202*a* at a first position, the second coin ejector 202*b* at a second position, and the third coin ejector 202*c* at a third position.

Each of the coin ejectors 202 may have a substantially similar shape and configuration. For example, as shown with respect to at least the first coin ejector 202*a*, the first coin ejector 202*a* includes a rectangular body 302. At a first end 304 of the rectangular body 302, the first coin ejector 202*a* may have an arcuate surface 306 extending up from the first end 304 of the rectangular body 302 such that a wall 308 is formed at the first end 304 of the rectangular body 302. The arcuate surface 306 may extend out on each side of the rectangular body 302, arcing in and toward the rectangular body 302. The arcuate surface 306 may further have a coin ledge 310 that is a surface extending above the arcuate surface 306 at the same angle as the arcuate surface 306. The coin ledge 310 may have a shorter arc than the arc of the arcuate surface 306, extending the width of the first end 304 of the rectangular body 302 of the coin ejector 202*a*. A second end 312 of the rectangular body 302 may be rotatably fixed to the coin canister 101 by a single fixation device 314, such as a pin or bolt, at a point around the perimeter 316 of and near the bottom 108 of the coin canister 101. For example, as illustrated in FIG. 3, the first coin ejector 202*a* is fixed at a 12 o'clock position, the second coin ejector 202*b* is fixed at a 4 o'clock position, and the third coin ejector 202*c* is fixed at an 8 o'clock position.

The coin payout apparatus 100 may include at least one mechanism for operating the at least one coin ejector 202 in order to eject a coin from a coin tube 102. In particular, one or more hopping discs 318 may be rotatably installed at positions below the coin ejectors 202. As illustrated in FIG. 3, a first hopping disc 318*a* is installed below the second coin ejector 202*b* at the second position, and a second hopping disc 318*b* is installed below the third coin ejector 202*c* at the third position, with there being no hopping disc installed at the first position below the first coin ejector 202*a*. In some embodiments, the hopping discs 318 do not rotate with the coin ejectors 202 or the associated tubes 102, but rather remain fixed at the second position and the third position. Each of the hopping discs 318 rotate in order to interact with the coin ejector 202 presently disposed above the hopping disc 318 in order to move the coin ejector 202 so that the coin ejector 202 ejects a coin from one of the tubes 102 associated with the coin ejector 202, depending on which of the tubes 102 is oriented over a payout position.

As shown in FIG. 3, a first hopping disc 318*a* installed below the second coin ejector 202*b* at the second position may cause the second coin ejector 202*b* to eject a coin from the fourth tube 102*d*. Similarly, a second hopping disc 318*b* installed below the third coin ejector 202*c* at the third position may cause the third coin ejector 202*c* to eject a coin from the fourth tube 102*e*. Conversely, because no hopping disc is located at the first position, the first coin ejector 202*a* is not able to eject a coin from either the first tube 102*a* or the second tube 102*b*.

Figure 4A:
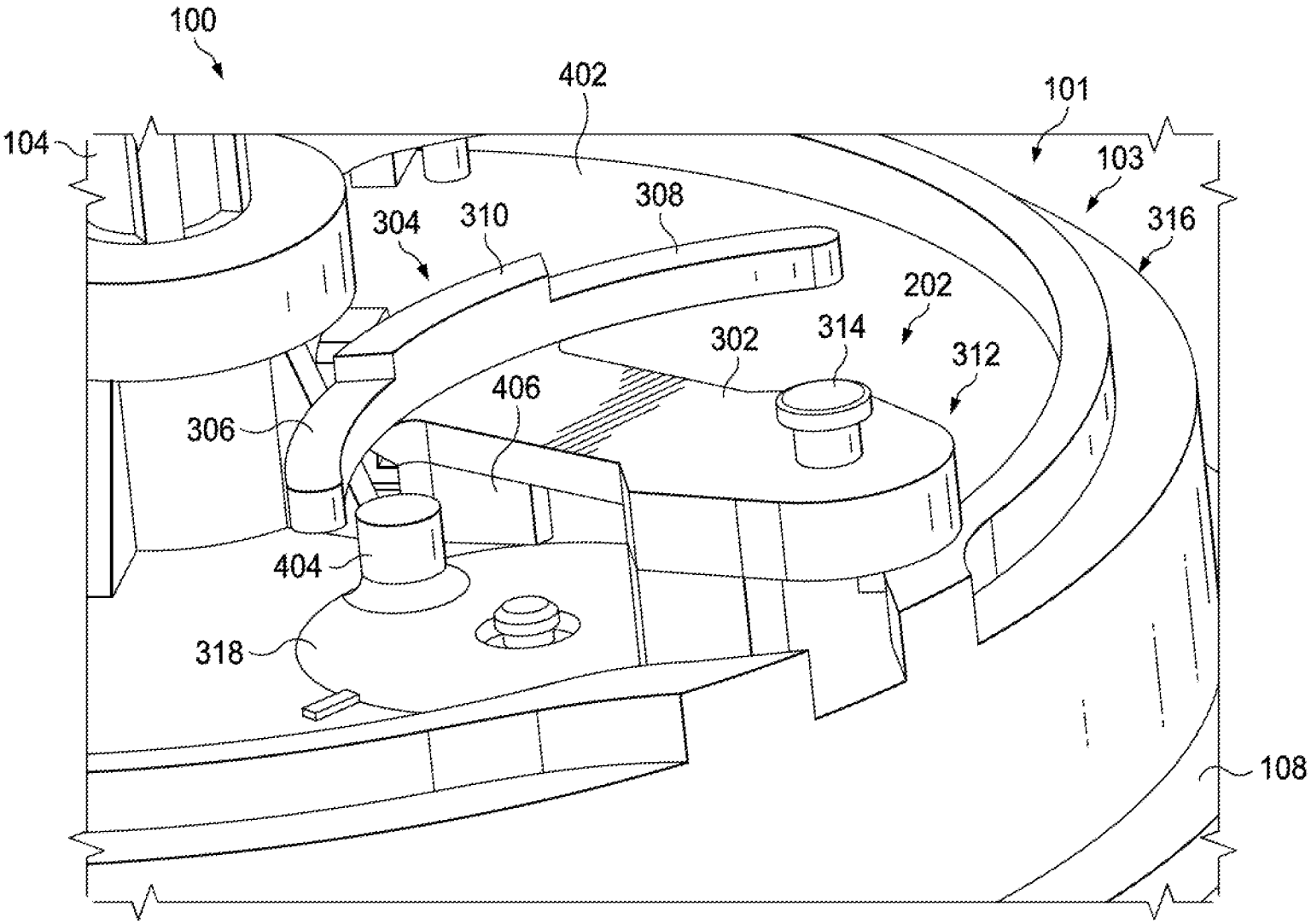
FIG. 4A illustrates a perspective view of a coin ejector and a hopping disc configuration in accordance with various embodiments of the present disclosure.
Figure 4B:
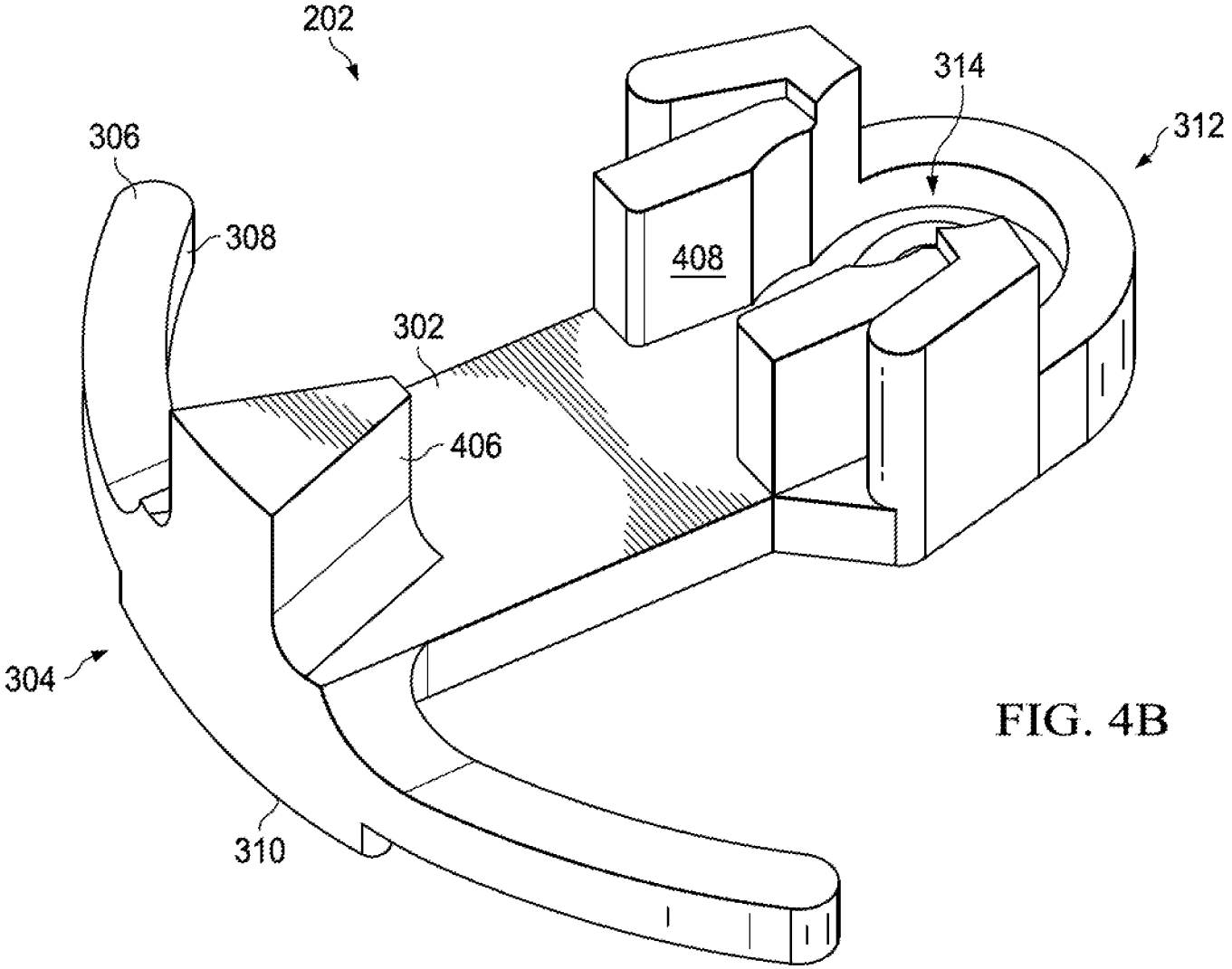
FIG. 4B illustrates a bottom perspective view of a coin ejector in accordance with various embodiments of the present disclosure.

Referring now to FIGS. 4A and 4B, FIG. 4A illustrates a perspective view of a coin ejector 202 and hopping disc 318 configuration and FIG. 4B illustrates a bottom perspective view of a coin ejector 202. As shown in FIGS. 4A and 4B, a coin ejector 202 is shown pivotally coupled to a point around the perimeter 316 of the coin canister 101. The coin ejector 202 is oriented in a default position with the rectangular body 302 of the ejector 202 extending from the second end 312 of the coin ejector 202 towards the center 104 of the cylindrical body 103 of the coin canister 101. A hopping disc 318 is pivotally coupled to a bottom surface 402 of the coin canister 101. As the hopping disc 318 rotates, a hopping pin 404 extending up from a top surface of the hopping disc 318 pushes against a first contact surface 406 disposed below a bottom surface of the coin ejector 202 at the first end 304 of the coin ejector 202 such that the coin ejector 202 is rotated toward the outer perimeter 316 of the coin canister 101. This movement causes the arcuate surface 306 of the coin ejector 202 to curve toward the outer perimeter 316 of the coin canister 101. Movement or curving of the arcuate surface 306 of the coin ejector 202 may cause the coin ledge 310 extending above the arcuate surface 306 to encounter a bottom coin in a tube 102 of the coin canister 101. When the arcuate surface 306 encounters a bottom coin in the tube 102 of the coin canister 101 a coin may be ejected from the tube 102. The first contact surface 406 may extend diagonally from a point starting at the first end 304 of the coin ejector 202 (e.g., near a side of the first end 304) and extend toward the middle of the bottom surface of the coin ejector 202.

As shown in FIG. 4B, as the hopping disc 318 continues to rotate, the hopping pin 404 will encounter a second contact surface 408 disposed near the second end 312 of the coin ejector 202. The second contact surface 408 may extend away from the second end 312 of the coin ejector 202 down a length of the rectangular body 302 of the coin ejector 202. The second contact surface 408 may extend a center of the rectangular body 302 such that the hopping pin 404 encounters the second contact surface 404 near the center of the rectangular body 302 and under the bottom surface of the coin ejector 202. When the hopping pin 404 encounters the second contact surface 408, the coin ejector 202 is pushed back to the default position.

It should be understood that in some embodiments, a coin ejector 202 may be associated with and disposed beneath a pair of tubes 102. Thus, when a coin canister 101 includes a configuration as illustrated in FIG. 3, two hopping discs may rotate in opposite directions. Accordingly, a first hopping disc may engage a coin ejector to rotate the coin ejector in a first direction to eject coins from a first tube of the pair of tubes 102 when the first tube of the pair of tubes 102 have moved into position with the first hopping disc. Similarly, a second hopping disc may engage the same coin ejector to rotate the coin ejector in a second direction, opposite the first direction, to eject coins from a second tube of the pair of tubes 102 when the second tube of the pair of tubes 102 have moved into position with the second hopping disc.

Figure 5A:
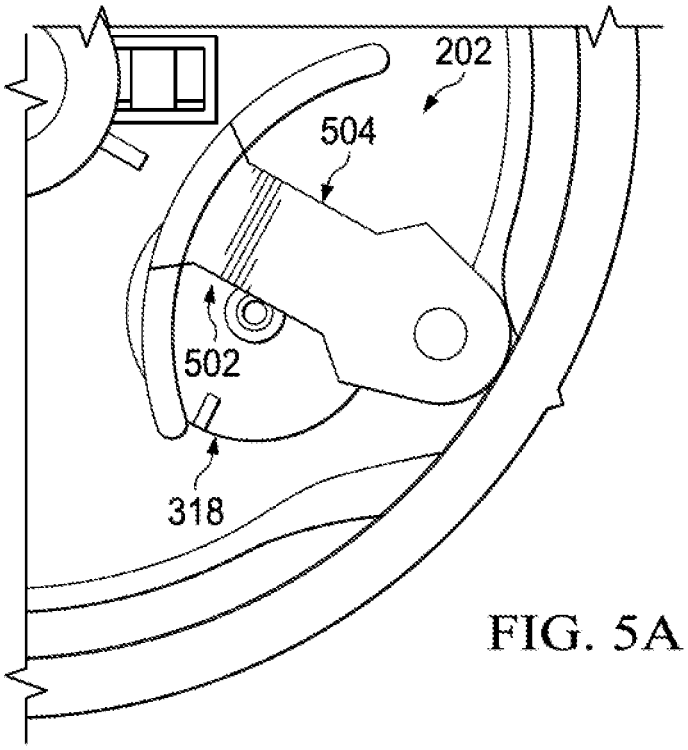
FIG. 5A illustrates a top view of a coin ejector rotation operation where the coin ejector is in a default position in accordance with various embodiments of the present disclosure.
Figure 5B:
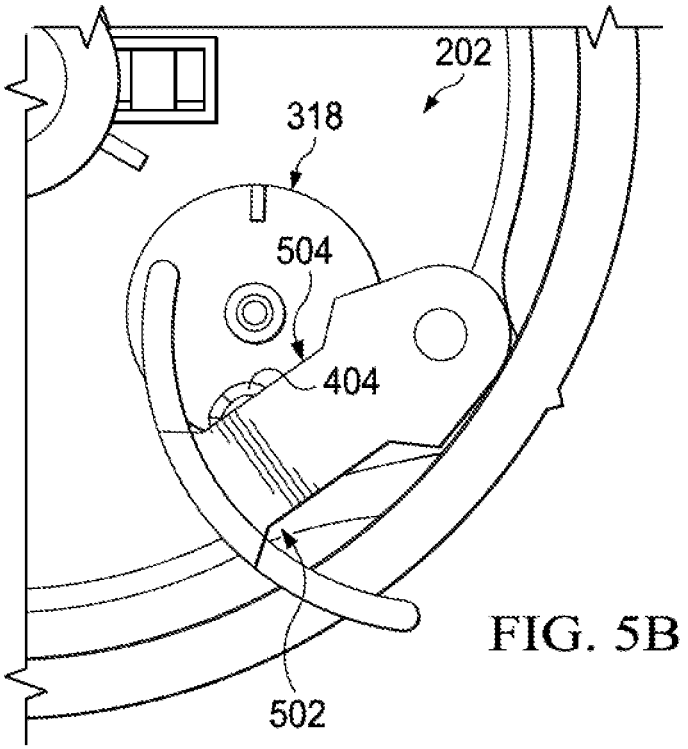
FIG. 5B illustrates a top view of a coin ejector rotation operation where the coin ejector is in an end position in accordance with various embodiments of the present disclosure.

Referring now to FIGS. 5A and 5B, there is illustrated a top view of a coin ejector rotation operation. As a hopping disc 318 rotates, the hopping pin 404 of the hopping disc 318 encounters the first contact surface 406 of the coin ejector 202 at a first contact point 502. As the hopping disc 318 continues to rotate, the coin ejector 202 is pushed causing the coin ejector 202 to pivot at the single fixation device 314 and rotate from a default position shown in FIG. 5A to an end position shown in FIG. 5B. The hopping disc 318 will then continue to rotate until the hopping pin 404 passes by the first contact surface 406 of the coin ejector 202. The hopping pin 404 will then encounter the second contact surface 408 of the coin ejector 202 at a second contact point 504. As the hopping disc 318 continues to rotate from the second contact point 504, the coin ejector 202 is pushed back to the default position. Rotation of the hopping disc 318 may continue so that additional coins may be ejected from the coin canister 101. When a coin ejector 202 is associated with and disposed beneath a pair of tubes 102, another hopping disc 318 may rotate in an opposite direction from the aforementioned hopping disc described in FIGS. 5A and 5B. In this case, when the pair of tubes 102 is moved into a position with the other hopping disc 318, the coin ejector 202 may be rotated in an opposite direction and cause a coin from the other tube of the pair of tubes 102 to be ejected.

Figure 6A:
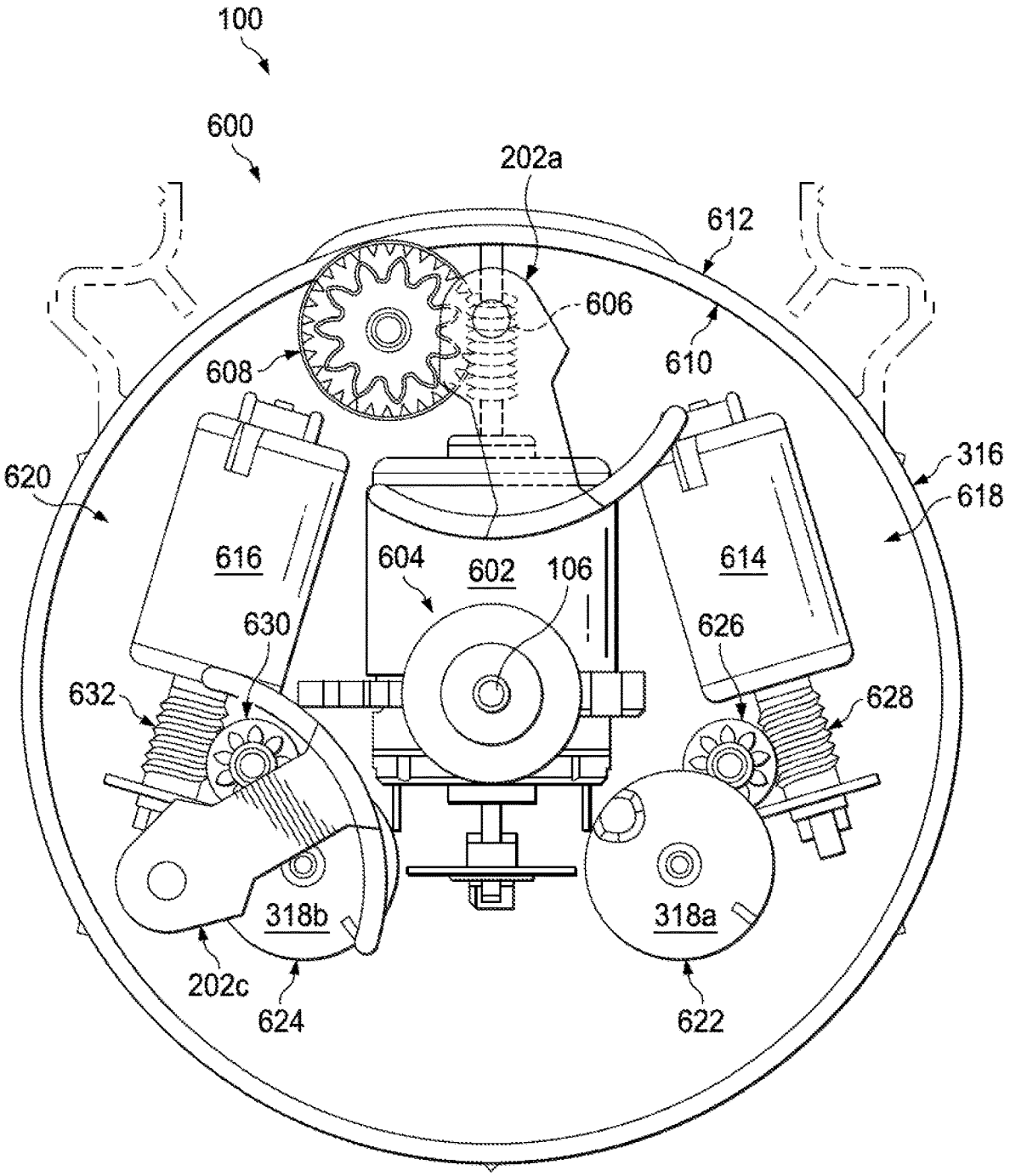
FIG. 6A illustrates a top view of a motor assembly of a coin payout apparatus in accordance with various embodiments of the present disclosure.
Figure 6B:
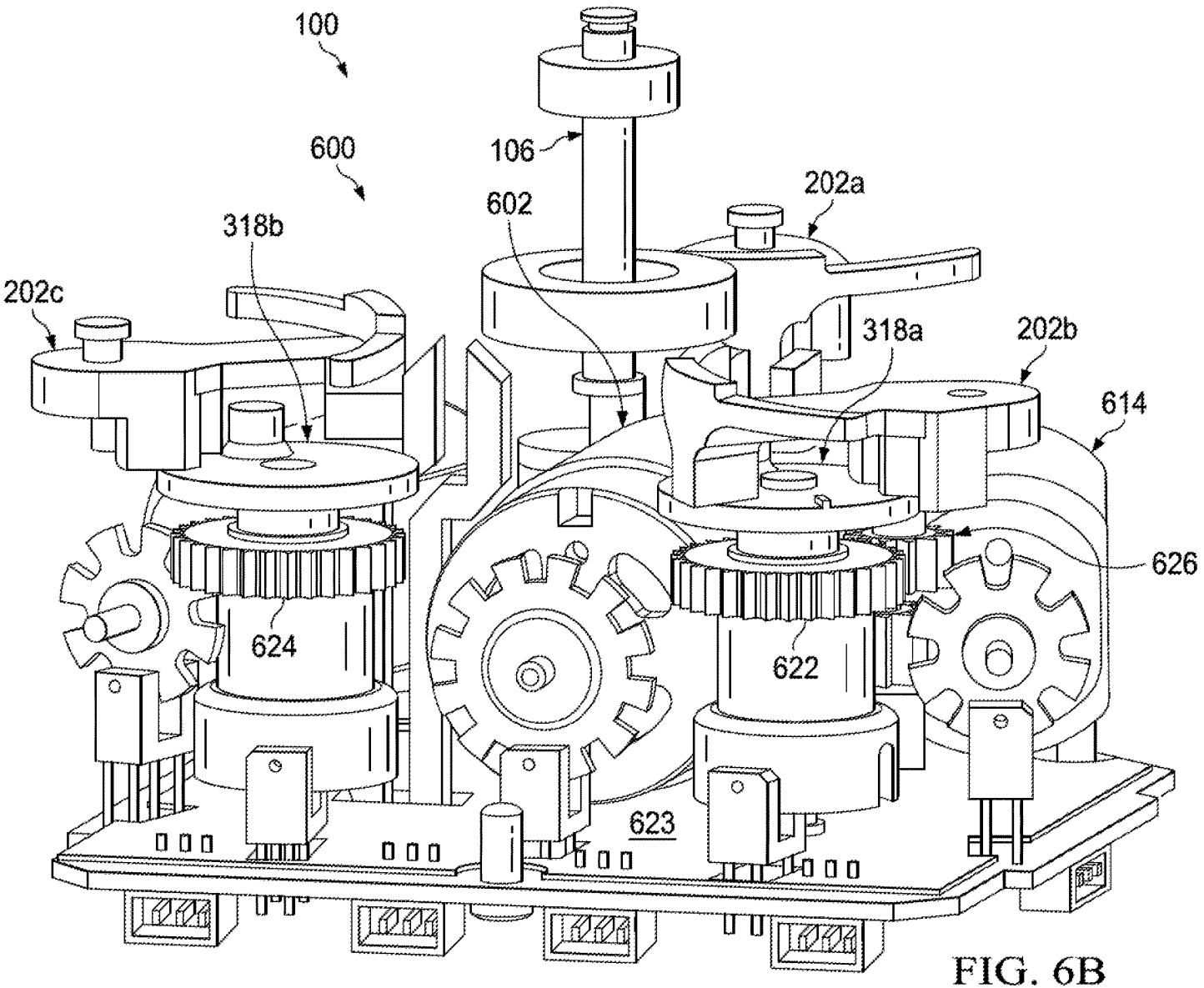
FIG. 6B illustrates a front perspective view of a motor assembly of a coin payout apparatus in accordance with various embodiments of the present disclosure.
Figure 6C:
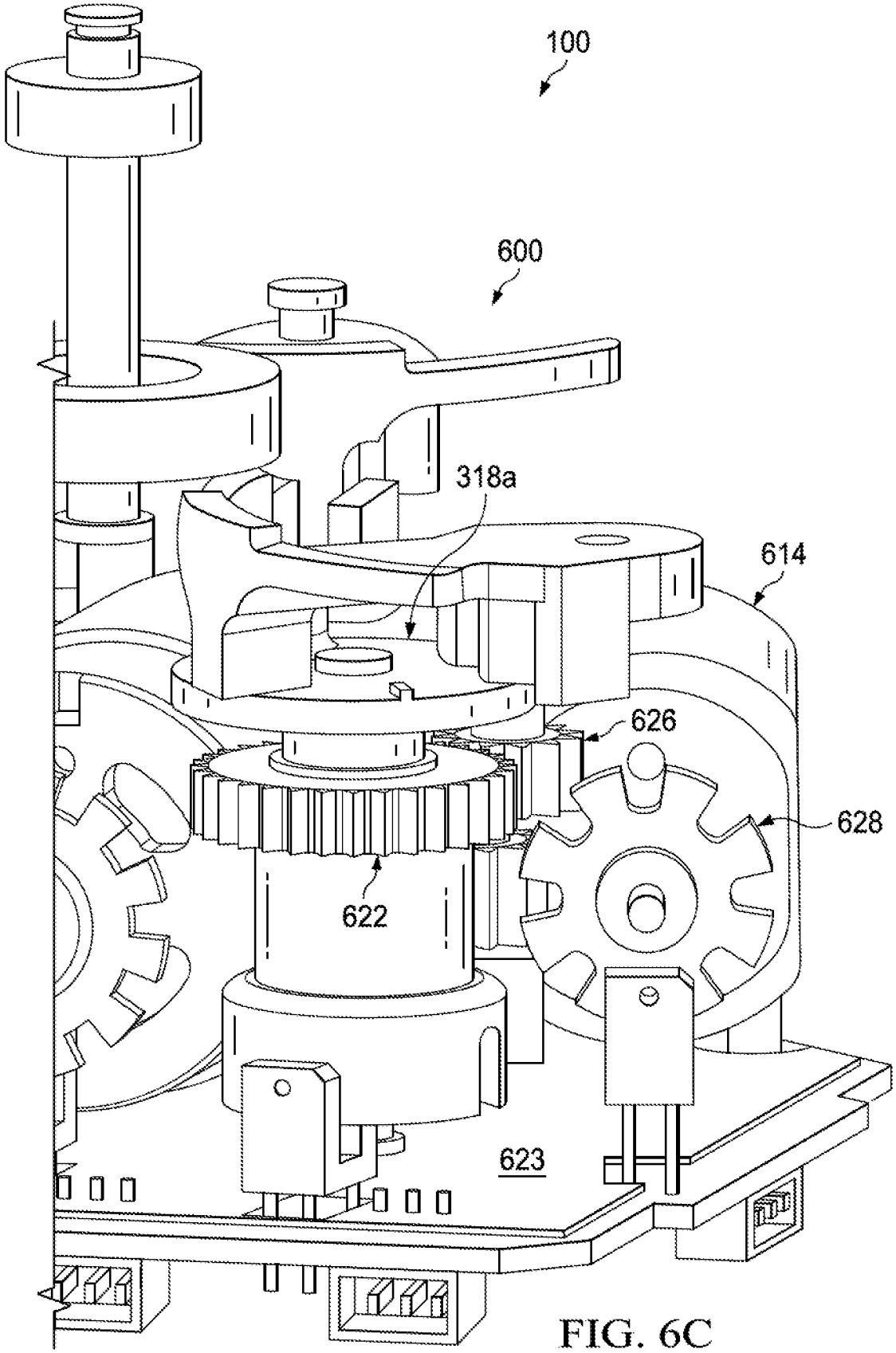
FIG. 6C illustrates a side enhanced perspective view of a motor assembly of a coin payout apparatus in accordance with various embodiments of the present disclosure.

Referring now to FIGS. 6A-6C, FIG. 6A illustrates a top view of a motor assembly 600 of a coin payout apparatus 100. FIG. 6B illustrates a front perspective view of a motor assembly 600 of a coin payout apparatus 100. FIG. 6C illustrates a side perspective view of a motor assembly 600 of a coin payout apparatus 100. The motor assembly 600 may be coupled to the bottom 108 of the coin canister 101 so that component of the motor assembly 600 may drive components of the coin canister 101 as described herein.

For example, as shown in FIGS. 6A, 6B, and 6C, the rotatable shaft 106 extends up from the motor assembly 600 and allows for a coin canister 101 to be placed thereon. A rotation motor 602 disposed near the center 604 of the motor assembly 600 includes a worm gear 606 that drives a first gear 608. The first gear 608 engages with an inner surface 610 of a wall 612 formed at the perimeter 316 of the coin canister 101 and drives the rotation of the coin canister 101 (e.g., the rotation of the cylindrical body 103 of the coin canister 101). The rotation of the coin canister 101 may cause the positions of the tubes 102 of the coin canister 101 as well as the positions of the coin ejectors 202 disposed beneath the tubes 102 of the coin canister 101 to rotate with the coin canister 101 and change positions with respect to a hopping disc 318 and one or more payout positions. The motor assembly 600 also includes a first payout motor 614 and a second payout motor 616. The first payout motor 614 is disposed on a first side 618 of the motor assembly 600 and the second payout motor 616 disposed on a second side 620 of the motor assembly 600.

The first hopping disc 318*a* is associated with the first payout motor 614 and the second hopping disc 318*b* is associated with the second payout motor 616. The first hopping disc 318*a* and the second hopping disc 318*b* are disposed at the top of a first rotatable gear shaft 622 and a second rotatable gear shaft 624, respectively. The first rotatable gear shaft 622 extends up from a base 623 of the motor assembly 600 in front of the first payout motor 614. The first gear shaft 622 (e.g., gear teeth of the first gear shaft 622) meshes with first intermediate gear 626. The first intermediate gear 626 meshes with a first worm gear 628 coupled to the first payout motor 614. Thus, the first payout motor 614 drives the rotation of the first hopping disc 318*a*, via the first worm gear 628, the first intermediate gear 626, and the first rotatable gear shaft 622. Similarly, the second rotatable gear shaft 624 similarly extends up from the base of the motor assembly 600 in front of the second payout motor 616. The second gear shaft 624 (e.g., gear teeth of the second gear shaft 624) meshes with second intermediate gear 630. The second intermediate gear 630 meshes with a second worm gear 632 coupled to the second payout motor 616. Thus, the second payout motor 616 drives the rotation of the second hopping disc 318*b*, via the second worm gear 632, the second intermediate gear 630, and the second rotatable gear shaft 624.

During operation of the motor assembly 600, the first hopping disc 318*a* may rotate clockwise while the second hopping disc 318*b* may rotate counter-clockwise. This causes the coin ejectors 202 situated over the first hopping disc 318*a* and the second hopping disc 318*b* to rotate in opposite directions and eject coins at the two payout positions. For example, when the position of the fourth tube 102*d* and the fifth tube 102*e* are as illustrated in FIG. 2A, the second hopping disc 318*b* causes coins to be ejected from the fifth tube 102*e* and the first hopping disc 318*a* causes coins to be ejected from the fourth tube 102*d*. As another example, if the coin canister 101 were in the position illustrated in FIG. 2B, the first hopping disc 318*a* would cause coins to be ejected from the first tube 102*a*, while the second hopping disc 318*b* would cause coins to be ejected from the sixth tube 102*f*. Since the coin ejectors 202 also rotate with their associated tubes 102, the coin ejectors 202 remain symmetrical with the associated tubes 102 during operation of the motor assembly 600 and rotation of the coin canister 101. This also allows for coin payout from any of the different tubes 102 on the coin canister 101 by rotating the coin canister 101 to position a needed tube 102 into one of the payout positions over the hopping discs 318. In certain embodiments, ejected coins may be ejected from the coin canister 101 and into a coin collection area.

One example embodiment of a coin payout apparatus can include a coin canister having a plurality of coin tubes for storing coins, a plurality of coin ejectors, wherein each one of the plurality of coin ejectors is associated with and disposed below two of the plurality of coin tubes, a rotation motor for rotating the coin canister, a first payout motor, a second payout motor, and a first hopping disc disposed on a first gear shaft, wherein the first payout motor rotates the first gear shaft, and a second hopping disc disposed on a second gear shaft, wherein the second payout motor rotates the second gear shaft. In one or more above examples, the coin canister is of a cylindrical shape.

In one or more examples, each one of the plurality of coin ejectors includes a first end that is pivotally coupled to a position along a perimeter of the coin canister. In one or more above examples, each one of the plurality of coin ejectors includes an arcuate surface disposed at a second end of the coin ejector, wherein the arcuate surface extends above a top surface of the coin ejector and arcs out from and in towards a body of the coin ejector. In one or more examples, each one of the plurality of coin ejectors includes a coin ledge extending above the arcuate surface. In one or more examples, each one of the plurality of coin ejectors includes a first contact surface disposed on a bottom surface of the coin ejector, the first contact surface extending from the second end of the coin ejector over the bottom surface of the coin ejector.

In one or more examples, each one of the plurality of coin ejectors includes a second contact surface disposed on the bottom surface of the coin ejector extending from a point near the first end of the coin ejector over the bottom surface of the coin ejector. In one or more examples, the first payout motor includes a first worm gear and the second payout motor includes a second worm gear. In one or more examples, the first worm gear meshes with a gear meshed with the first gear shaft. In one or more examples, the second worm gear meshes with a gear meshed with the second gear shaft. In one or more examples, rotation of the first gear shaft and the second gear shaft rotates the first hopping disc and the second hopping disc, respectively. In one or more examples, the first hopping disc includes a first hopping pin extending from a top surface of the first hopping disc.

In one or more examples, the second hopping disc includes a second hopping pin extending from a top surface of the second hopping disc. In one or more examples, rotation of the first hopping disc causes the first hopping pin to encounter the first contact surface of one of the plurality of coin ejectors, wherein continued rotation of the first hopping disc after the first hopping pin encounters the first contact surface results in rotation of the encountered coin ejector toward a perimeter of the coin canister. In one or more examples, the first hopping disc is rotated clockwise. In one or more examples, rotation of the second hopping disc causes the second hopping pin to encounter the first contact surface of one of the plurality of coin ejectors, wherein continued rotation of the second hopping disc after the second hopping pin encounters the first contact surface results in rotation of the encountered coin ejector toward a perimeter of the coin canister.

In one or more examples, the first hopping disc is rotated counter-clockwise. In one or more examples, rotation of one of the plurality of coin ejectors causes the coin ledge of the one of the plurality of coin ejectors to encounter a coin disposed with one of the plurality of coin tubes of the coin canister, and causes the coin to be ejected from the one of the plurality of coin tubes. In one or more examples, a central shaft is disposed within a center chamber of the coin canister. In one or more examples, the rotation motor rotates the coin canister in order to position one or more tubes of the coin canister over either the first hopping disc or the second hopping disc.

In certain embodiments, a coin payout apparatus is provided. The coin payout apparatus may include a coin canister. The coin canister may include a tube for storing coins. The coin canister may also include a coin ejector operable to eject a coin from the tube. The coin canister may further include a hopping disc operable to rotate and engage the coin ejector to eject the coin from the tube when the tube is moved into position with the hopping disc. In certain embodiments, the coin apparatus may further include a motor assembly including a payout motor operable to rotate the hopping disc to engage the coin ejector when the tube is moved into position with the hopping disc. In certain embodiments, the hopping disc may be disposed on a gear shaft, and the payout motor may rotate the gear shaft to rotate the hopping disc. In certain embodiments, the coin canister may also include a cylindrical body, and the tube may be positioned on a perimeter of the cylindrical body. In certain embodiments, the cylindrical body may be operable to rotate to move the tube into position with the hopping disc. In certain embodiments, the coin payout apparatus may further include a motor assembly including a rotation motor operable to rotate the cylindrical body to move the tube into position with the hopping disc. In certain embodiments, the hopping disc may be a first hopping disc and the coin canister may include a second hopping disc. In certain embodiments, the first hopping disc may be operable to rotate in a first rotational direction and the second hopping disc may be operable to rotate in a second rotational direction opposite the first rotational direction. In certain embodiments, the hopping disc may be unable to engage the coin ejector to eject the coin from the tube when the tube is not moved into position with the tube.

In certain embodiments, a coin payout apparatus is provided. The coin payout apparatus may include a coin canister. The coin canister may include a tube for storing coins. The coin canister may also include a coin ejector operable to eject a coin from the tube. The coin canister may further include a hopping disc operable to rotate and engage the coin ejector to eject the coin from the tube when the tube is moved into position with the hopping disc. The coin payout apparatus may also include a motor assembly including a payout motor operable to rotate the hopping disc to engage the coin ejector when the tube is moved into position with the hopping disc. In certain embodiments, the coin canister may also include a cylindrical body, and the tube may be positioned on a perimeter of the cylindrical body. In certain embodiments, the cylindrical body may be operable to rotate to move the tube into position with the hopping disc. In certain embodiments, the motor assembly may include a rotation motor operable to rotate the cylindrical body to move the tube into position with the hopping disc. In certain embodiments, the hopping disc may be disposed on a gear shaft, and the payout motor may rotate the gear shaft to rotate the hopping disc.

In certain embodiments, a coin payout apparatus is provided. The coin payout apparatus may include a coin canister. The coin canister may include a first tube for storing coins. The coin canister may include a second tube for storing coins. The coin canister may include a first coin ejector operable to eject a coin from the first tube. The coin canister may include a second coin ejector operable to eject a coin from the second tube. The coin canister may include a hopping disc. The hopping disc may be operable to rotate and engage the first coin ejector to eject the coin from the first tube when the first tube is moved into position with the hopping disc. The hopping disc may be operable to rotate and engage the second coin ejector to eject the coin from the second tube when the second tube is moved into position with the hopping disc. In certain embodiments, the first coin ejector may include a first contact surface, the second coin ejector may include a second contact surface, and the hopping disc may include a hopping pin extending from a surface of the hopping disc. In certain embodiments, when the first tube is moved into position with the hopping disc, the hopping disc may be operable to rotate to move the hopping pin into engagement with the first contact surface causing the first coin ejector to pivot and eject the coin from the first tube. In certain embodiments, when the second tube is moved into position with the hopping disc, the hopping disc may be operable to rotate to move the hopping pin into engagement with the second contact surface causing the second coin ejector to pivot and eject the coin from the second tube. In certain embodiments, the coin canister may include a cylindrical body and the first tube and the second tube may be positioned around a perimeter of the cylindrical body. In certain embodiments, the cylindrical body may be operable to rotate to move the first tube into position with the hopping disc and rotate to move the second tube into position with the hopping disc. In certain embodiments, the coin payout apparatus may further include a motor assembly. The motor assembly may include a rotation motor that is operable to rotate the cylindrical body to move the first tube into position with the hopping disc and rotate the cylindrical body to move the second tube into position with the hopping disc. In certain embodiments, coin payout apparatus may include a motor assembly. The motor assembly may include a payout motor operable to rotate the hopping disc to engage the first coin ejector when the first tube is moved into position with the hopping disc and rotate the hopping disc to engage the second coin ejector when the second tube is moved into position with the hopping disc. In certain embodiments, the hopping disc may be a first hopping disc and the coin canister may include a second hoping disc operable to rotate and engage the first coin ejector to eject the coin from the first tube when the first tube is moved into position with the second hopping disc and rotate and engage the second coin ejector to eject the coin from the second tube when the second tube is moved into position with the second hopping disc.

A coin payout apparatus is provided. The coin payout apparatus may include a coin canister and a base or a bottom. The coin canister may include a plurality of tubes for storing coins, characterized in that the coin canister can be rotated with respect to the base or bottom. In certain embodiments, the coin payout apparatus may further include at least one coin ejector. In certain embodiments, the at least one coin ejector can be rotated together with the coin canister with respect to the base or the bottom. In certain embodiments, the at least one coin ejector can eject a coin from at least one tube only if the at least one tube is positioned at one or two predetermined positions with respect to the base or the bottom. In certain embodiments, the at least one coin ejector may be assigned to at least two tubes. In certain embodiments, the at least one coin ejector may be assigned to at least two tubes such that the at least one coin ejector can eject a coin from one of the at least two tubes dependent on a position of the at least two tubes with respect to the base or the bottom. In certain embodiments, the at least one coin ejector is operable to be moved or rotated in two opposite directions to eject a coin either from one tube out of the at least two tubes or from the other tube out of the at least two tubes. In certain embodiments, the coin payout apparatus may include multiple coin ejectors where each tube is assigned to a specific coin ejector and where each coin ejector is assigned to at least two tubes. In certain embodiments, the coin payout apparatus may further include at least one mechanism for operating the at least one coin ejector in order to eject a coin from a tube. In certain embodiments, the at least one mechanism for operating the at least one coin ejector may be connected to the base or the bottom. In certain embodiments, the at least one mechanism for operating the at least one coin ejector may be connected to the base or the bottom such that the at least one mechanism is unable to be rotated together with the coin canister. In certain embodiments, the at least one mechanism may be designed to operate one coin ejector in case of multiple coin ejectors if the coin ejector is positioned at a predetermined position at or above the at least one mechanism. In certain embodiments, the coin payout apparatus may include at least two mechanisms where each mechanism may be configured to operate a specific coin ejector if the respective coin ejector is positioned at a predetermined position. In certain embodiments, the coin payout apparatus may further include at least two payout positions where at least one mechanism may be configured to operate at least one coin ejector to eject a coin from a first tube at a first payout position, and where at least one other mechanism may be configured to operate at least one other coin ejector to eject a coin from a second tube at a second payout position. In certain embodiments, each mechanism may include a hopping disc that is adapted to rotate a coin ejector for releasing a coin from a tube. In certain embodiments, the at least two mechanisms may be positioned at two payout positions, where each mechanism of the at least two mechanisms may include a hopping disc, and where one hopping disc may be adapted to rotate a coin ejector in a clockwise direction when the one hopping disc is arranged in a first payout position, and where one other hopping disc may be adapted to rotate a coin ejector in a counterclockwise direction when the one other hopping disc is arranged in a second payout position. In certain embodiments, each mechanism may include a payout motor. In certain embodiments, each payout motor may be operable to rotate a hopping disc to engage the coin ejector when the tube is moved into position with the hopping disc. In certain embodiments, the coin payout apparatus may include a rotation motor for rotating the coin canister. In certain embodiments, the coin payout apparatus may include six tubes, three coin ejectors with each coin ejector being assigned to two tubes of the six tubes. The coin payout apparatus may also include two mechanisms for operating the coin ejectors. A first mechanism may operate one coin ejector when the first mechanism is arranged at a first payout position. A second mechanism may operate another coin ejector when the second mechanism is arranged at a second payout position. In certain embodiments, each tube may be configured to hold multiple coins of a specific denomination which is different compared to the denomination of the respective other tubes. In certain embodiments, each tube may have a different internal diameter compared to the respective other tubes.

The description in the present application should not be read as implying that any particular element, step, or function is an essential or critical element that must be included in the claim scope. The scope of patented subject matter is defined only by the allowed claims. Moreover, none of the claims invokes 35 U.S.C. § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," "processor," or "controller" within a claim is understood and intended to refer to structures known to those skilled in the relevant art, as further modified or enhanced by the features of the claims themselves, and is not intended to invoke 35 U.S.C. § 112(f).

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A coin payout apparatus comprising:

a coin canister including:

a tube for storing coins, wherein the tube is operable to move within the coin canister to a payout position, a coin ejector operable to move with the tube when the tube moves within the coin canister and operable to eject a coin from the tube when at the payout position, and a hopping disc operable to rotate and engage the coin ejector to eject the coin from the tube when the tube and the coin ejector are moved into the payout position over the hopping disc.

2. The coin payout apparatus of claim 1, further comprising:

a motor assembly including a payout motor operable to rotate the hopping disc to engage the coin ejector when the tube and the coin ejector are moved into the payout position over the hopping disc.

3. The coin payout apparatus of claim 2, wherein the hopping disc is disposed on a gear shaft, and wherein the payout motor rotates the gear shaft to rotate the hopping disc.

4. The coin payout apparatus of claim 1, wherein the coin canister comprises a cylindrical body, and wherein the tube is positioned on a perimeter of the cylindrical body.

5. The coin payout apparatus of claim 4, wherein the cylindrical body is operable to rotate to move the tube and the coin ejector into the payout position over the hopping disc.

6. The coin payout apparatus of claim 5, further comprising:

a motor assembly including a rotation motor operable to rotate the cylindrical body to move the tube and the coin ejector into the payout position over the hopping disc.

7. The coin payout apparatus of claim 1, wherein the hopping disc is a first hopping disc, and wherein the coin canister further includes a second hopping disc.

8. The coin payout apparatus of claim 7, wherein the first hopping disc is operable to rotate in a first rotational direction, and wherein the second hopping disc is operable to rotate in a second rotational direction opposite the first rotational direction.

9. The coin payout apparatus of claim 1, wherein the hopping disc is unable to engage the coin ejector to eject the coin from the tube when the tube is not moved into the payout position with the tube.

10. A coin payout apparatus, comprising:

a coin canister including:

a tube for storing coins, wherein the tube is operable to move within the coin canister to a payout position, a coin ejector operable to move with the tube when the tube moves within the coin canister and operable to eject a coin from the tube when at the payout position, and a hopping disc operable to rotate and engage the coin ejector to eject the coin from the tube when the tube and the coin ejector are moved into the payout position over the hopping disc; and a motor assembly including a payout motor operable to rotate the hopping disc to engage the coin ejector when the tube and the coin ejector are moved into the payout position over the hopping disc.

11. The coin payout apparatus of claim 10, wherein the coin canister includes a cylindrical body, and wherein the tube is positioned on a perimeter of the cylindrical body.

12. The coin payout apparatus of claim 11, wherein the cylindrical body is operable to rotate to move the tube and the coin ejector into the payout position over the hopping disc.

13. The coin payout apparatus of claim 12, wherein the motor assembly further includes a rotation motor operable to rotate the cylindrical body to move the tube and the coin ejector into the payout position over the hopping disc.

14. The coin payout apparatus of claim 10, wherein the hopping disc is disposed on a gear shaft, and wherein the payout motor rotates the gear shaft to rotate the hopping disc.

15. A coin payout apparatus, comprising:

a coin canister including:

a first tube for storing coins, wherein the first tube is operable to move within the coin canister, a second tube for storing coins, wherein the second tube is operable to move within the coin canister, a first coin ejector operable to move with the first tube when the first tube moves within the coin canister and operable to eject a coin from the first tube, a second coin ejector operable to move with the second tube when the second tube moves within the coin canister and operable to eject a coin from the second tube, and a hopping disc operable to:

rotate and engage the first coin ejector to eject the coin from the first tube when the first tube and the first coin ejector are moved into a position over the hopping disc, and rotate and engage the second coin ejector to eject the coin from the second tube when the second tube and the second coin ejector are moved into the position over the hopping disc.

16. The coin payout apparatus of claim 15, wherein:

the first coin ejector includes a first contact surface;

the second coin ejector includes a second contact surface;

the hopping disc includes a hopping pin extending from a surface of the hopping disc;

when the first tube and the first coin ejector are moved into the position over the hopping disc, the hopping disc is operable to rotate to move the hopping pin into engagement with the first contact surface causing the first coin ejector to pivot and eject the coin from the first tube; and when the second tube and the second coin ejector are moved into the position over the hopping disc, the hopping disc is operable to rotate to move the hopping pin into engagement with the second contact surface causing the second coin ejector to pivot and eject the coin from the second tube.

17. The coin payout apparatus of claim 15, wherein the coin canister includes a cylindrical body, and wherein the first tube and the second tube are positioned around a perimeter of the cylindrical body.

18. The coin payout apparatus of claim 17, wherein the cylindrical body is operable to:

rotate to move the first tube and the first coin ejector into the position over the hopping disc; and rotate to move the second tube and the second coin ejector into the position over the hopping disc.

19. The coin payout apparatus of claim 18, further comprising:

a motor assembly including:

a rotation motor operable to:

rotate the cylindrical body to move the first tube and the first coin ejector into the position over the hopping disc, and rotate the cylindrical body to move the second tube and the second coin ejector into the position over the hopping disc.

20. The coin payout apparatus of claim 15, further comprising:

a motor assembly including:

a payout motor operable to:

rotate the hopping disc to engage the first coin ejector when the first tube and the first coin ejector are moved into the position over the hopping disc, and rotate the hopping disc to engage the second coin ejector when the second tube and the second coin ejector are moved into the position with the hopping disc.

21. The coin payout apparatus of claim 15, wherein the hopping disc is a first hopping disc, and wherein the coin canister further includes:

a second hopping disc operable to:

rotate and engage the first coin ejector to eject the coin from the first tube when the first tube and the first coin ejector are moved into another position over the second hopping disc, and rotate and engage the second coin ejector to eject the coin from the second tube when the second tube and the second coin ejector are moved into another position over the second hopping disc.

* * * * *